United States Patent [19]

Wells

[11] 4,129,844

[45] Dec. 12, 1978

[54] MULTI-DIRECTIONAL POSITIONER

[75] Inventor: William M. Wells, Midfield, Ala.

[73] Assignee: Thomas H. Hudson, Birmingham, Ala. ; a part interest

[21] Appl. No.: 815,519

[22] Filed: Jul. 14, 1977

[51] Int. Cl.[2] ..... H01F 7/18

[52] U.S. Cl. ..... 335/268; 60/325

[58] Field of Search ..... 335/266, 267, 268, 272; 60/325

[56] References Cited

U.S. PATENT DOCUMENTS

| | | | |
|---|---|---|---|
| 671,907 | 4/1901 | Duncan | 335/279 X |
| 2,878,445 | 3/1959 | Scarborough | 335/266 X |
| 3,789,285 | 1/1974 | Nishizawa | 335/268 X |
| 3,935,486 | 1/1976 | Nagashima | 335/268 X |

FOREIGN PATENT DOCUMENTS

| | | | |
|---|---|---|---|
| 1127470 | 4/1962 | Fed. Rep. of Germany | 335/272 |

*Primary Examiner*—George Harris

*Attorney, Agent, or Firm*—Woodford R. Thompson, Jr.

[57] ABSTRACT

A multi-directional positioner for moving one element relative to another element wherein a socket in a housing receives a ball with a rotating fit with a portion of the ball projecting outwardly of the socket and being connected to one element and the housing being connected to the other element. An arcuate groove in the socket extends in a plane passing generally through the center of the ball and receives an electrically actuated power unit which is pivotally connected to the side of the ball. An arcuate groove in the outer surface of the ball extends in a plane passing generally through the center of the ball and perpendicular to the groove in the socket and receives an electrically actuated power unit which is pivotally connected to the adjacent portion of the housing. The power units are energized singularly and/or jointly to impart relative movement between the ball and the housing.

7 Claims, 4 Drawing Figures

MULTI-DIRECTIONAL POSITIONER

CROSS REFERENCE TO RELATED APPLICATION

This invention is an improvement to the invention disclosed and claimed in my copending U.S. application Ser. No. 670,571, filed Mar. 25, 1976 now U.S. Pat. No. 4,045,958.

BACKGROUND OF THE INVENTION

This invention relates to a multi-directional positioner for moving one element relative to another whereby a work piece or tool carried by one element may be moved selectively to a plurality of positions in planes at right angles to each other.

Heretofore in the art to which my invention relates, many devices have been proposed for operatively connecting one element to another element whereby relative movement is imparted between the elements to thus move at least one of the elements to selected positions. Such devices are complicated in construction and are very expensive to manufacture and maintain. Also, such devices require a considerable amount of space for the operation thereof. That is, such devices usually comprise ring gears, pinion gears, worm gear reducers and the like, or fluid pressure operated cylinders which require piston rods, links and similar equipment.

BRIEF SUMMARY OF INVENTION

In accordance with my invention, I provide a multi-directional positioner for moving one element relative to another wherein a ball and socket type unit is operatively connected to the elements. An arcuate groove is provided in the socket and extends in a plane passing generally through the center of the ball and receives an electrically actuated power unit which is pivotally connected to an adjacent side of the ball. Also, an arcuate groove is provided in the outer surfaces of the ball and extends in a plane passing generally through the center of the ball and perpendicular to the groove in the socket and receives an electrically actuated power unit which is pivotally connected to an adjacent portion of the housing. Means is provided for selectively energizing the power units in the arcuate grooves in the ball and socket to impart relative movement between the ball and the socket. Accordingly, my improved positioner is simple of construction, economical of manufacture, requires a fewer number of parts and brings about a greater savings in space required to install the unit. Also, my improved directional positioner is simple to operate whereby it may be operated by unskilled labor.

DESCRIPTION OF THE DRAWINGS

Apparatus embodying features of my invention is illustrated in the accompanying drawings, forming a part of this application, in which.

DETAILED DESCRIPTION

Figure 2:
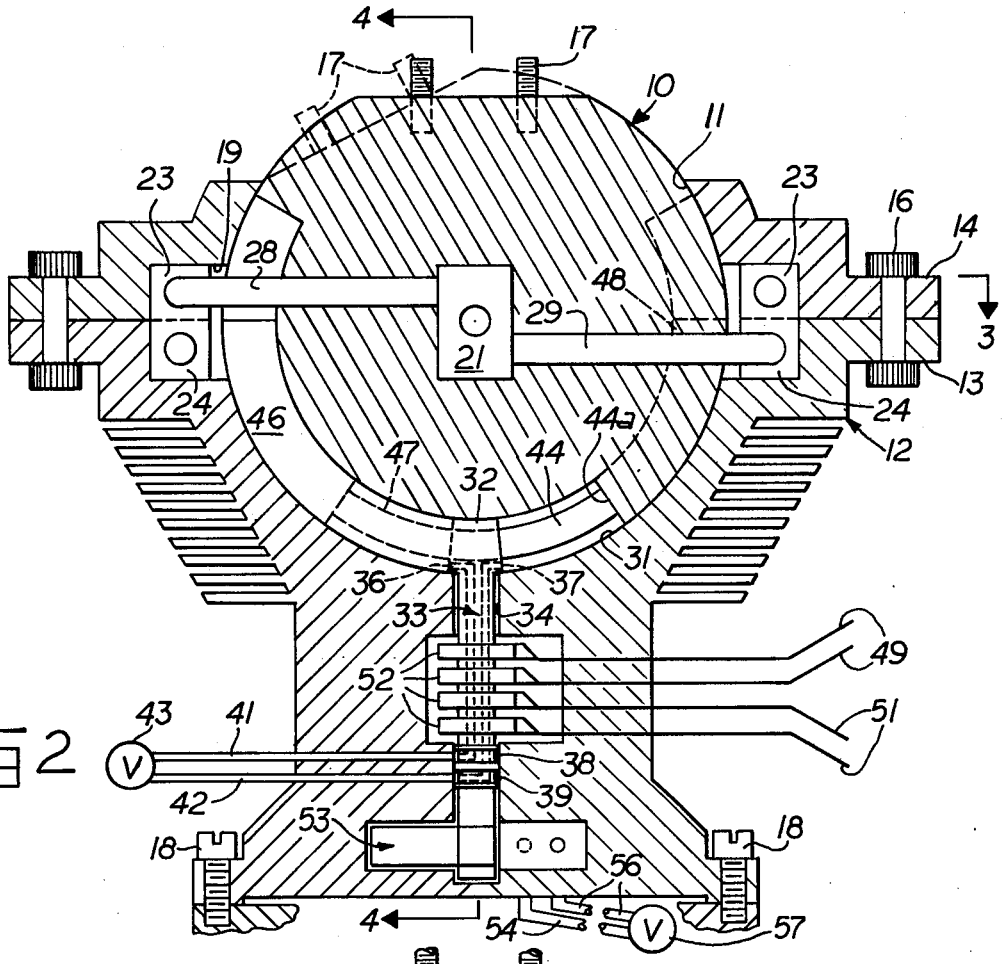
FIG. 2 is a vertical sectional view taken generally along the line 2—2 of FIG. 1.
Figure 4:
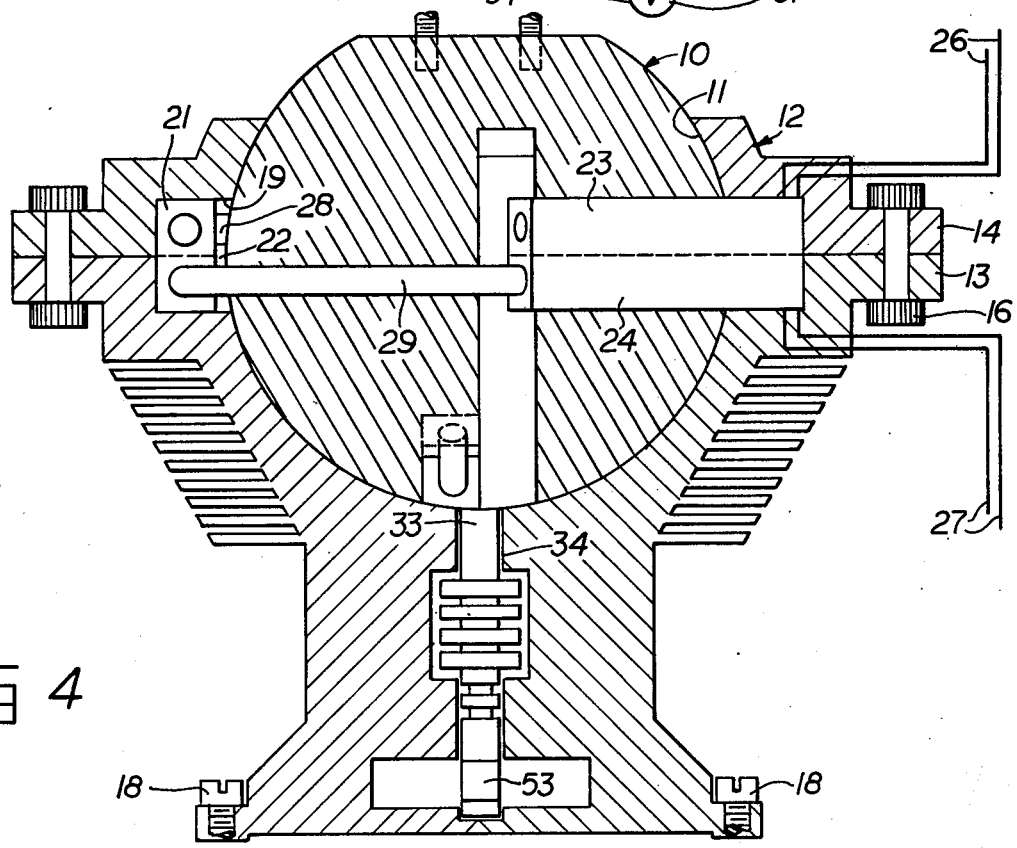

Referring now to the drawings for a better understanding of my invention, I show a ball-like member 10 which is mounted for rotation in a socket 11 provided in a housing 12. As shown in FIGS. 2 and 4, the housing 12 is split adjacent the center of the ball-like member 10 to provide a lower portion 13 and an upper portion 14 which are detachably connected to each other by suitable retaining bolts 16. The inner surface of the socket 11 extends an angular distance around the ball-like member 10 whereby the ball-like member 10 is retained in the socket with a portion of the ball-like member 10 projecting outwardly of the socket 11, as shown. The ball-like member 10 is provided with suitable connector members 17, such as outwardly projecting threaded members, whereby the ball-like member may be connected to another element, such as an adjacent piece of machinery in the form of a boom or the like. The housing 12 is connected to another element, such as an adjacent piece of machinery, by suitable bolts 18.

Figure 1:
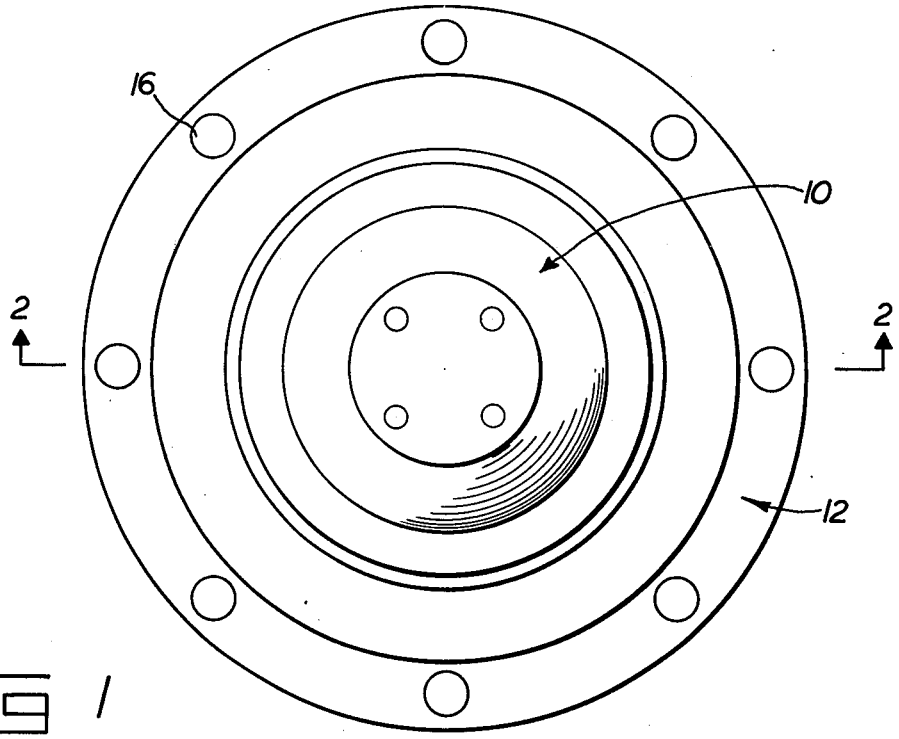
FIG. 1 is a top plan view showing my improved directional positioner.
Figure 3:
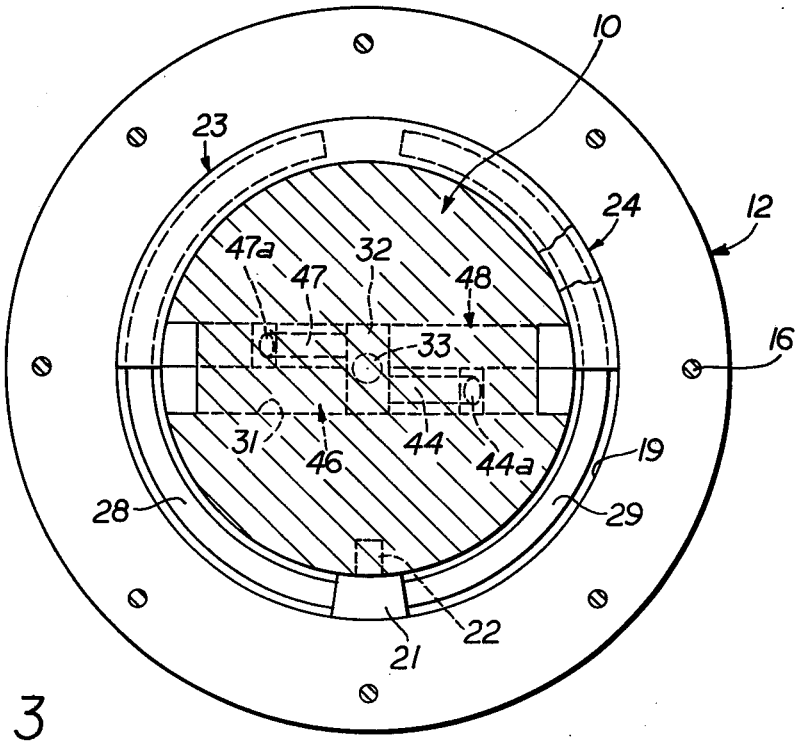
FIG. 3 is a sectional view taken generally along the line 3—3 of FIG. 2; and, FIG. 4 is a sectional view taken generally along the line 4—4 of FIG. 2.

As shown in FIGS. 2, 3 and 4, an arcuate groove 19 is provided in the inner surface of the socket 11 in housing 12 with each groove 19 extending in a plane passing generally through the center of the ball-like member 10. A pivot mounting member 21 is mounted for movement in the arcuate groove 19 and is pivotally connected by an inwardly extending pivot pin or shaft 22 to the adjacent side of the ball-like member 10, as shown in FIGS. 3 and 4. Upper and lower electrical solenoids 23 and 24, respectively, are fixedly mounted within the arcuate groove 19 at opposite sides of the pivot mounting member 21.

As shown in FIG. 3, the upper solenoid 23 and the lower solenoid 24 are both of an arcuate shape corresponding to that of the groove 19 with the upper solenoid being connected to electrical leads 26 and the lower solenoid being connected to electrical leads 27. Movable armatures 28 and 29 are carried by the solenoids 23 and 24, respectively and are also of a shape corresponding to the shape of the groove 19 whereby they are free to move therein. The ends of the armatures 28 and 29 are connected to the pivot mounting member 21 so as to impart relative movement between the ball-like member 10 and the housing 12. That is, to impart counter-clockwise rotation to the ball-like member 10, as viewed in FIG. 3, the lower solenoid 24 is energized by supplying current through leads 27 thereby causing the lower armature 29 to be pulled into the coil of solenoid 24 and thus rotate the pivot mounting member 21 and the ball-like member counter-clockwise. To rotate the ball-like member 10 in a clockwise direction, as viewed in FIG. 3, the upper solenoid 23 is energized by supplying current through lines 26 thereby causing the upper armature 28 to be pulled into the coil of solenoid 23 and thus rotate the pivot mounting member 21 and the ball-like member clockwise.

An arcuate groove 31 is provided in the outer surface of the ball-like member 10 with the groove 31 extending in a plane passing generally through the center of the ball-like member 10 and perpendicular to the arcuate groove 19 in the inner surface of the housing 12. Mounted in the arcuate groove 31 is a piston-like member 32 which carries a laterally and outwardly projecting shaft-like member 33 which is mounted for rotation in a bearing recess 34 carried by the housing 12, as shown in FIGS. 2 and 4. As shown in FIG. 2, the piston-like member 32 and its laterally projecting shaft-like member 33 are provided with fluid passageways 36 and 37 therethrough for circulating fluid from the arcuate groove 31 at either side of the piston-like member 32. The passageways 36 and 37 communicate with annular grooves 38 and 39, respectively, which communicate with conduits 41 and 42, which in turn are connected to each other by a needle valve 43 to meter the flow of fluid from one side of the piston-like member 32 to the other to thus produce a dampening or locking effect, to be described hereinafter.

As shown in FIGS. 2 and 3, an arcuate shaped armature 44 extends through and projects from one side of the piston-like member 32 and is connected to an adjacent portion of the ball-like member 10, as at 44*a*. As shown in FIG. 3, the side of the piston-like member 32 from which armature 44 projects defines the end portion of an arcuate shaped electrical solenoid 46 which receives the armature 44 and is mounted for movement in the arcuate groove 31 in the ball-like member 10. An arcuate shaped armature 47 extends through and projects from the other side of the piston-like member 32 and is connected to an adjacent portion of the ball-like member 10, as at 47*a*. The side of piston-like member 32 from which the armature 47 projects defines the end portion of an arcuate shaped electrical solenoid 48 which receives the armature 47 and is mounted for movement in the arcuate groove 31 in the ball-like member 10. The solenoids 46 and 48 are connected to electrical leads 49 and 51, respectively by conventional rotary contact units indicated generally at 52.

To produce clockwise rotation of the ball-like member 10, as viewed in FIG. 2, the solenoid 46 is actuated by energizing electrical leads 49 whereby current flows through the two upper rotary contact units 52. This causes armature 44 to be drawn into the coil of solenoid 46, thus rotating the ball-like member 10 in a clockwise direction.

To produce counter-clockwise rotation of ball-like member 10, as viewed in FIG. 2, the solenoid 48 is actuated by energizing electrical leads 51 whereby current flows through the two lower rotary contact units 52. This causes armature 47 to be drawn into the coil of solenoid 48, thus rotating the ball-like member 10 in a counter-clockwise direction.

To dampen or restrain movement of the solenoids 23 and 24 a rotary vane pump or actuator indicated generally at 53 is keyed to the shaft-like member 33 whereby it rotates with the ball-like member 10 due to the mounting of the solenoids 46 and 48 and their end portions defining the member 32 within the arcuate groove 31. Since such rotary vane-type pumps or actuators are well known in the art, no further description thereof is deemed necessary. The vanes of the actuator 53 cause circulation of fluid through conduits 54 and 56 which are connected to each other by a needle valve 57 to meter the flow of fluid therethrough to thus produce a dampening or locking effect on the action of solenoids 23 and 24.

From the foregoing description, the operation of my improved multi-directional positioner will be readily understood. The ball-like member 10 is connected to one element or working tool by the connector members 17 while the housing 12 is connected to another element or supporting structure by the retaining bolts 18. To rotate the ball-like member 10 in a vertical plane, as viewed in FIG. 2, the solenoids 46 and 48 are actuated selectively by energizing the electrical leads 49 and 51, selectively, to cause either clockwise or counterclockwise rotation of the ball-like member. That is, to rotate the ball-like member in a vertical plane and in a clockwise direction as viewed in FIG. 2, the solenoid 46 is actuated. To rotate the ball-like member 10 in the opposite direction, the solenoid 48 is actuated. To rotate the ball-like member 10 in a horizontal plane, as viewed in FIG. 2, the solenoids 23 and 24 are actuated selectively by energizing the electrical leads 26 and 27 to move the pivot mounting member 21 and the ball-like member 10 in the desired direction. That is, to rotate the ball-like member 10 in a clockwise direction, as viewed in FIG. 3, the solenoid 23 is actuated and to rotate the ball-like member in a counterclockwise direction, as viewed in FIG. 3, the solenoid 24 is actuated.

From the foregoing, it will be seen that I have devised an improved multi-directional positioner which is simple of construction, economical of manufacture and one which may be operated by unskilled labor. By providing a self-contained unit, the positioner requires a minimum of space for installation, thus facilitating installation and permitting use of my improved positioner in locations where a minimum of space is available.

While I have shown my invention in but one form, it will be obvious to those skilled in the art that it is not so limited, but is susceptible of various changes and modifications without departing from the spirit thereof.

What I claim is:

1. In a multi-directional positioner for moving one element relative to another element, (a) a ball-like member, (b) a housing having a socket therein receiving said ball-like member with a rotating fit with the inner surface of said socket extending an angular distance around said ball-like member to retain said ball-like member in said socket with a portion of said ball-like member projecting outwardly of said socket, (c) means operatively connecting said portion of the ball-like member projecting outwardly of said socket to said one element, (d) means operatively connecting said housing to said another element, (e) at least one arcuate groove in the inner surface of said housing extending in a plane passing generally through the center of said ball-like member, (f) at least one first arcuate shaped electrical power unit fixedly mounted within said arcuate groove in said housing and being extendable and retractable lengthwise of said arcuate groove in said housing and pivotally connected adjacent one end to an adjacent side of said ball-like member, (g) means to actuate said first power unit to selectively extend and retract said first power unit within said arcuate groove in said housing to rotate said ball-like member selectively in opposite directions and impart relative movement between said ball-like member and said housing, (h) at least one arcuate groove in the outer surface of said ball-like member extending in a plane passing generally through the center of said ball-like member and perpendicular to said arcuate groove in the inner surface of said housing, (i) at least one second arcuate shaped electrical power unit mounted in said arcuate groove in the outer surface of said ball-like member and being extendable and retractable lengthwise of said arcuate groove in said ball-like member and connected adjacent one end thereof to said ball-like member and pivotally connected adjacent the other end thereof to an adjacent portion of said housing, and (j) means to actuate said second power unit to selectively extend and retract said second power unit within said arcuate groove in the outer surface of said ball-like member to rotate said ball-like member selectively in opposite directions and impart relative movement between said ball-like member and said housing.

2. A multi-directional positioner as defined in claim 1 in which said power unit comprises an electrical solenoid and an armature which are movable relative to each other.

3. A multi-directional positioner as defined in claim 1 in which said second arcuate shaped electrical power unit is pivotally connected adjacent said other end to an adjacent portion of said housing by a piston-like member and fluid conveying means operatively connects portions of said arcuate groove in said ball-like member at opposite sides of said piston-like member to a needle valve to restrain flow of fluid from one side of said arcuate groove in said ball-like member to the other side thereof and produce a dampening effect on the extension and retraction of said second power unit.

4. A multi-directional positioner as defined in claim 3 in which said piston-like member carries a laterally and outwardly projecting shaft-like member which is mounted for rotation in a bearing recess carried by said housing.

5. A multi-directional positioner as defined in claim 4 in which a rotary actuator is operatively connected to said shaft-like member and communicates with said fluid conveying means to restrain rotation of said shaft-like member and produce a dampening effect on the extension and retraction of said first power unit.

6. A multi-directional positioner as defined in claim 4 in which said shaft-like member is provided with fluid passageways therethrough which communicate with fluid passages through said piston-like member to provide said fluid conveying means.

7. A multi-directional positioner as defined in claim 1 in which a pair of said first electrical power units are fixedly mounted within said arcuate groove in said housing for imparting relative movement between said ball-like member and said housing in opposite directions and a pair of said second electrical power units are mounted in said arcuate groove in the outer surface of said ball-like member for imparting relative movement between said ball-like member and said housing in opposite directions.

* * * * *